US008096793B2

(12) United States Patent
Sun

(10) Patent No.: US 8,096,793 B2
(45) Date of Patent: Jan. 17, 2012

(54) DUCTILE CAST IRON SCROLL COMPRESSOR

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 1128 days.

(21) Appl. No.: 11/386,306

(22) Filed: Mar. 22, 2006

(65) Prior Publication Data

US 2007/0224068 A1 Sep. 27, 2007

(51) Int. Cl.

| | |
|---|---|
| ***F01C 1/02*** | (2006.01) |
| ***F01C 1/063*** | (2006.01) |
| ***F01C 21/04*** | (2006.01) |
| ***F04C 2/00*** | (2006.01) |
| ***F04C 29/02*** | (2006.01) |

(52) U.S. Cl. ..... 418/55.6; 418/55.1; 418/179

(58) Field of Classification Search ..... 418/55.1, 418/178, 179, 55.6

See application file for complete search history.

(56) References Cited

U.S. PATENT DOCUMENTS

| | | | | |
|---|---|---|---|---|
| 3,055,756 | A | 9/1962 | Kanter et al. | |
| 4,363,661 | A | 12/1982 | Kovacs | |
| 4,944,663 | A | 7/1990 | Iizuka et al. | |
| 5,087,181 | A | 2/1992 | Kamitsuma et al. | |
| 5,277,562 | A * | 1/1994 | Fukuhara et al. | 418/55.2 |
| 5,439,360 | A | 8/1995 | Barito | |
| 5,548,973 | A | 8/1996 | Komine et al. | |
| 5,580,230 | A | 12/1996 | Keifer et al. | |
| 5,580,401 | A | 12/1996 | Williamson | |
| 5,755,271 | A | 5/1998 | Williamson | |
| 5,806,336 | A * | 9/1998 | Sunaga et al. | 418/179 |
| 6,006,542 | A | 12/1999 | Tojo | |
| 6,053,714 | A | 4/2000 | Fenocchi et al. | |
| 6,055,827 | A * | 5/2000 | Tojo et al. | 62/468 |
| 6,077,057 | A * | 6/2000 | Hugenroth et al. | 418/55.4 |
| 6,135,739 | A * | 10/2000 | Ogawa et al. | 418/55.5 |
| 6,139,296 | A * | 10/2000 | Okajima et al. | 418/178 |
| 6,176,094 | B1 * | 1/2001 | Ohta et al. | 62/114 |
| 6,189,322 | B1 * | 2/2001 | Ishihara et al. | 62/114 |
| 6,286,334 | B1 | 9/2001 | Tojo | |
| 6,302,665 | B1 | 10/2001 | Esumi et al. | |
| RE37,520 | E | 1/2002 | Williamson | |
| 6,527,528 | B1 * | 3/2003 | Barito et al. | 418/55.5 |

(Continued)

FOREIGN PATENT DOCUMENTS

| | | |
|---|---|---|
| EP | 1331395 | 7/2003 |
| EP | 1544469 | 6/2005 |
| EP | 1652949 | 3/2006 |
| JP | 59079089 | 5/1984 |
| JP | 09329091 | 12/1997 |
| WO | 2006072663 | 7/2006 |

OTHER PUBLICATIONS

European Search Report dated Sep. 14, 2007.

(Continued)

*Primary Examiner* — Mary A Davis

(74) *Attorney, Agent, or Firm* — Carlson Gaskey & Olds, P.C.

(57) ABSTRACT

A scroll compressor includes a scroll member having a base and a generally spiral wrap that extends from the base to define a portion of a compression chamber. The scroll member is made of a cast iron material comprising a microstructure having graphite nodules.

12 Claims, 3 Drawing Sheets

U.S. PATENT DOCUMENTS

| | | | | |
|---|---|---|---|---|
| 6,598,421 | B1 | 7/2003 | Suzuki | |
| 6,667,285 | B1 * | 12/2003 | Kawahara et al. | 508/485 |
| 6,705,848 | B2 | 3/2004 | Scancarello | |
| 6,761,545 | B1 * | 7/2004 | Witham et al. | 418/55.5 |
| 6,860,315 | B2 | 3/2005 | Williamson | |
| 6,874,325 | B2 | 4/2005 | Suzuki | |
| 6,878,677 | B1 | 4/2005 | Sakanoue | |
| 6,948,922 | B2 | 9/2005 | Esumi et al. | |
| 7,265,080 | B2 * | 9/2007 | Iso et al. | 508/182 |
| 2004/0140018 | A1 | 7/2004 | Sato et al. | |
| 2005/0210891 | A1 * | 9/2005 | Matsumoto et al. | 62/114 |
| 2006/0191604 | A1 | 8/2006 | Itoh et al. | |
| 2007/0122302 | A1 | 5/2007 | Sun | |

OTHER PUBLICATIONS

Metallurgy and Properties of Gray Irons, ASM Specialty Handbook, ASM International, 1996.

Heat Treating of Gray Irons, ASM Specialty Handbook, ASM International, 1996.

Standard Specification for Gray Iron Casings, ASTM International.

Standard Test Method for Evaluating the Microstructure of Graphite in Iron Castings, ASTM.

Ferrous Castings, Automotive Gray Iron Castings, SAE J431.

Standard Specification for Ductile Iron Castings, ASTM International.

Heat Treating of Ductile Irons, ASM Specialty Handbook, ASM International, 1996.

Metallurgy and Properties of Ductile Irons, ASM Specialty Handbook, ASM International, 1996.

Automotive Ductile (Nodular) Iron Castings, SAE J434 Feb. 2004.

European Search Report Dated Sep. 26, 2007.

* cited by examiner

DUCTILE CAST IRON SCROLL COMPRESSOR

BACKGROUND OF THE INVENTION

This application relates to scroll compressors and, more particularly, to a scroll compressor member with improved strength and durability.

Scroll compressors are becoming widely utilized in refrigerant compression systems. As known, a pair of scroll members each has a base with a generally spiral wrap extending from the base. Typically, one scroll is non-orbiting and the other scroll orbits relative to the non-orbiting scroll. The orbiting scroll contacts the non-orbiting scroll to seal and define compression chambers. When the orbiting scroll member is caused to orbit relative to the other, the size of the compression chambers decreases toward a discharge port, and refrigerant is compressed.

One example refrigerant compression system includes an air conditioning or other environmental conditioning system. As is known, a compressor compresses a refrigerant and sends the refrigerant to a downstream heat exchanger, and typically a condenser. From the condenser, the refrigerant travels through a main expansion device, and then to an indoor heat exchanger, typically an evaporator. From the evaporator, the refrigerant returns to the compressor. Generally, the performance and efficiency of the system relies, at least in part, on the capacity and efficiency of the scroll compressor. Thus, there has been a trend toward higher capacity and higher efficiency scroll compressors.

One concern in designing higher capacity scroll compressors is the strength and durability of the scroll members. Higher capacity compressors operate under increasingly severe conditions, such as higher forces and increased wear between the scroll members. Use of current materials for the scroll members has proven successful in many compressors but may not be suited for more severe operating conditions. For example, under extreme operating conditions, the scroll members may break or wear excessively. Thus, even though higher capacity designs may be available, stronger and more durable scroll member materials are needed to realize the capacity benefits of such designs.

Accordingly, it would be desirable to provide scroll members that are able to withstand more severe conditions in order to enhance compressor capacity.

SUMMARY OF THE INVENTION

One embodiment of a scroll compressor includes a scroll member having a base and a generally spiral wrap that extends from the base to define at least part of a compression chamber. The scroll member has a microstructure having graphite nodules. An ether-based lubricant lubricates at least part of a bearing that is adjacent the scroll member.

One embodiment scroll compressor includes a pair of scroll members that each have a base and a generally spiral wrap that extends from the base. The spiral wraps inter-fit to define a compression chamber and at least one of the scroll members includes a microstructure having graphite nodules. A motor-driven shaft selectively drives at least one of the scroll members. Three plain bearings support the shaft, and an ether-based lubricant lubricates the bearings.

One embodiment method of manufacturing the scroll compressor includes the steps of melting a cast iron material to produce a molten material, adding a nodule-forming agent to the molten material, and transferring the molten material into a mold having a shape of a scroll compressor member.

In the disclosed examples, the scroll member is relatively strong and durable. This allows the scroll compressor to withstand more severe operating conditions associated with high capacity compressor designs.

The above examples are not intended to be limiting. Additional examples are described below. These and other features of the present invention can be best understood from the following specification and drawings, the following of which is a brief description.

DETAILED DESCRIPTION OF THE PREFERRED EMBODIMENT

Figure 1:
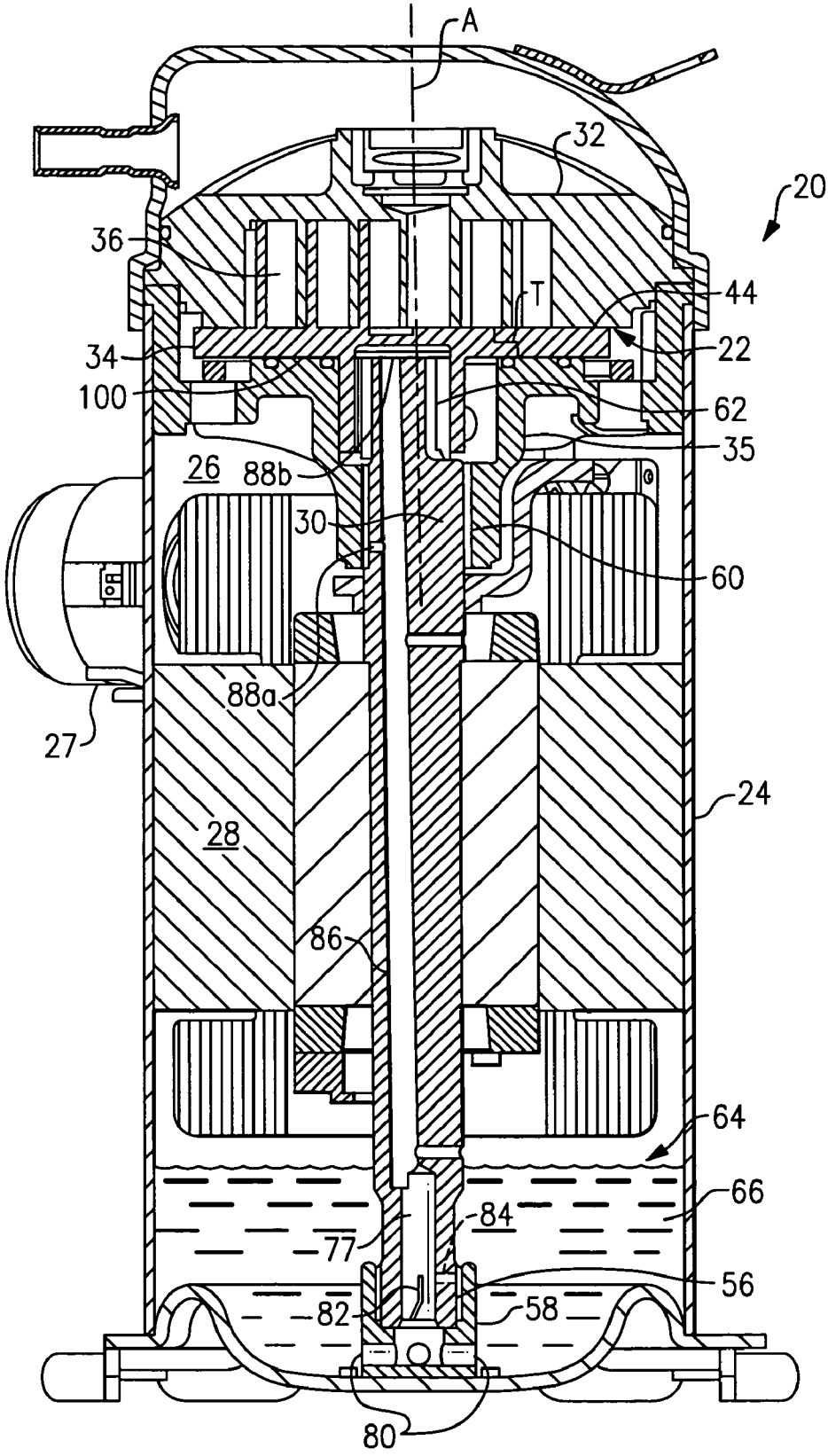
FIG. 1 is a cross-sectional view of an example scroll compressor.

FIG. 1 shows a scroll compressor 20. As shown, a compressor pump set 22 is mounted within a sealed shell 24. A suction chamber 26 receives a suction refrigerant from a tube 27. As can be appreciated, this refrigerant can circulate within the chamber 26, and flows over an electric motor 28. The electric motor 28 drives a shaft 30 that defines an operative axis A for the compressor 20. The compressor pump set 22 includes a non-orbiting scroll 32 and an orbiting scroll 34 that is supported on a crankcase 35. As is known, the shaft 30 drives the orbiting scroll 34 to orbit relative to the non-orbiting scroll 32 to compress the refrigerant.

In this example, the shaft 30 is supported within the compressor 20 by three different bearing bushings. The bottom of the shaft 30 includes a first bearing bushing 56, or lower bearing bushing, which is received in a bearing hub 58. A second bearing bushing 60, or crankcase bearing bushing, is located farther toward the top of the compressor 20 between the shaft 30 and the crankcase 35. A third bearing bushing 62, or orbiting scroll bearing bushing, is located near the top of the shaft 30 between the orbiting scroll 34 and the shaft 30.

As can be appreciated from the operation of the compressor 20, the bearing bushings 56, 60, and 62 are lubricated to reduce wear between friction surfaces of the bearing bushings 56, 60, and 62. To this end, the sealed shell 24 of the compressor 20 includes a lubricant reservoir 64 to hold an ether-based lubricant 66. In this example, the reservoir 64 is charged with a desired amount of the ether-based lubricant 66.

In a further example, the ether-based lubricant 66 is polyvinylether. Polyvinylether is not susceptible to significant hydrolysis, which is a concern with ester-based lubricants that degrade in the presence of water to form metallic soaps, acids, or other byproducts that are undesirable for compressor operation. Furthermore, different viscosities of polyvinylether have similar properties, such as miscibility in the refrigerant, which is another drawback of ester-based lubricants having properties that change significantly with different viscosities. Additionally, polyvinylether provides enhanced lubricity compared to ester-based lubricants. The polyvinylether reduces friction and wear at friction surfaces, especially the ones with boundary lubrication. This provides the advantage of reduced compressor 20 power consumption and reduced wear between the scroll wrap tips and the scroll bases compared to similar compressors using ester-based lubricant. In a further example, polyvinylether provides a friction coefficient that is 20%-30% lower than ester-based lubricant.

Optionally, the polyvinylether includes one or more additives to enhance its performance. In one example, extreme pressure ("EP") additives are used in the polyvinylether to decrease wear under high pressures. The EP additive (or additives) reacts with the metal surfaces of the compressor 20 to form a boundary film that reduces wear between friction surfaces in the scroll members 32 and 34 and at the bearing bushings 56, 60, and 62. In one example, the EP additives include one or more of an organic sulfur, a phosphorus compound, or a chlorine compound. In a further example, the EP additive includes tricresylphosphate. Given this description, one of ordinary skill in the art will recognize additives or additive packages to meet their particular needs.

Optionally, additional types of additives are used to further enhance the performance of the polyvinylether, such as anti wear agents, lubricants, corrosion and oxidation inhibitors, metal surface deactivators, free radical scavengers, foam control agents, and the like.

The polyvinylether lubricant also has an associated viscosity. In one example, the viscosity is between 1 centistokes (cSt)@40° C. and 140 cSt@40° C. In a further example, the viscosity is between about 10 cSt@40° C. and about 68 cSt@40° C. In a further example, the viscosity is about 32 cSt@40° C. The term "about" is used in this description to refer to the nominal viscosity, which may vary within a tolerance of a few centistokes from an experimental viscosity.

The selected viscosity impacts the efficiency of the compressor 20. For example, less viscose lubricant provides less shear resistance between friction surfaces within the bearing bushings 56, 60, and 62. However, if the viscosity is too low, it will not provide a desired amount of lubricity. With previous ester-based lubricants, scroll compressors similar to the illustrated compressor 20 typically utilize a viscosity of 32 or 68 cSt@40° C. to provide a desired amount of lubricity. Lowering the viscosity of such ester-based lubricants to obtain enhanced efficiency results in an undesirable amount of wear from the lowered lubricity. However, the enhanced lubricity of ether-based lubricant 66 allows a lower viscosity than for the ester-based lubricant to be used without sacrificing lubricity.

In one example, the polyvinylether viscosity is 22 cSt@40° C. (i.e., lower than the 32 cSt@40° C. of typically used ester-based lubricants) to obtain enhanced compressor 20 efficiency. This provides a desirable combination of lubricity and enhanced compressor 20 efficiency compared to prior, typical ester-based lubricants. Given this description, one of ordinary skill will recognize a suitable viscosity to meet their particular lubrication and efficiency needs.

In the illustrated example, the shaft 30 functions as a centrifugal pump to deliver the ether-based lubricant 66 to each of the bearing bushings 56, 60, and 62. The shaft 30 includes a first passage 77 that receives ether-based lubricant 66 through lubricant inlets 80. A paddle 82 rotates with the shaft 30 to pump oil through the first passage 77. In this example, a feed opening 84 fluidly connects the first passage 77 to the first bearing bushing 56 such that ether-based lubricant 66 is provided through the feed opening 84 as the paddle 82 pumps with rotation of the shaft 30.

A second passage 86 in the shaft 30 is in fluid connection with the first passage 77. In this example, the second passage 86 is offset from the first passage 77 and cooperates with the first passage 77 in a known manner to centrifugally pump the ether-based lubricant 66 to the bearing bushings 56, 60, and 62. In this example, the second passage includes feed openings 88*a* and 88*b*. In the illustrated example, the feed opening 88*b* is an opening in the top of the shaft 30.

The feed opening 88*a* provides ether-based lubricant 66 to the second bearing bushing 60 in a similar manner as the feed opening 84 in the first passage 77. The ether-based lubricant flows out the feed opening 88*b* in the end of the shaft 30 to lubricate the third bearing bushing 62. After lubricating the respective bearing bushings 56, 60, and 62, gravitational force causes the ether-based lubricant 66 to flow back into the reservoir 64 in a known manner through return flow passages through the compressor 20.

Figure 3:
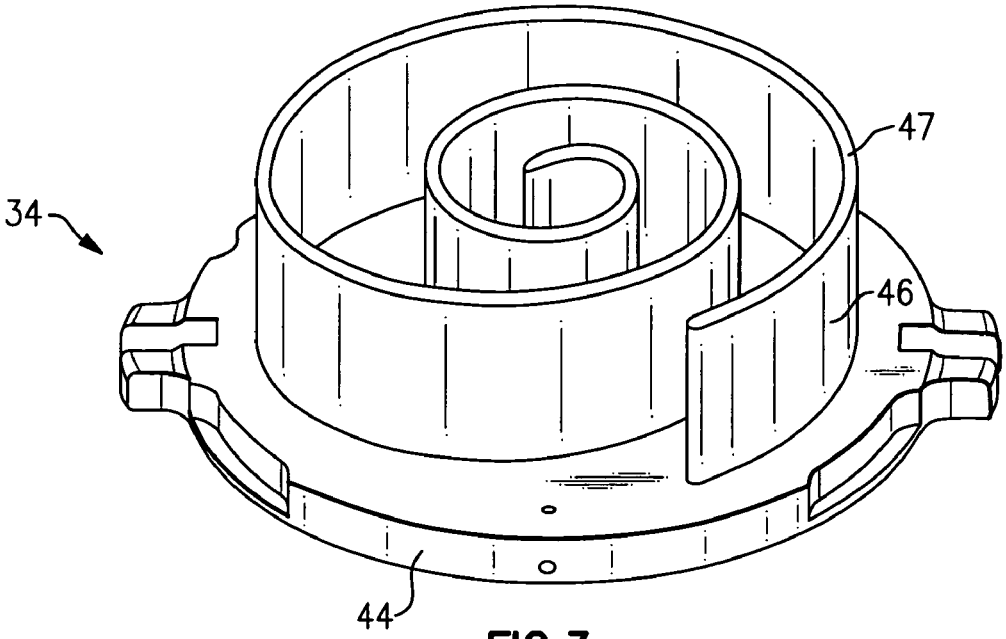
FIG. 3 is a perspective view of an orbiting scroll member for use in the scroll compressor of FIG. 1.
Figure 2:
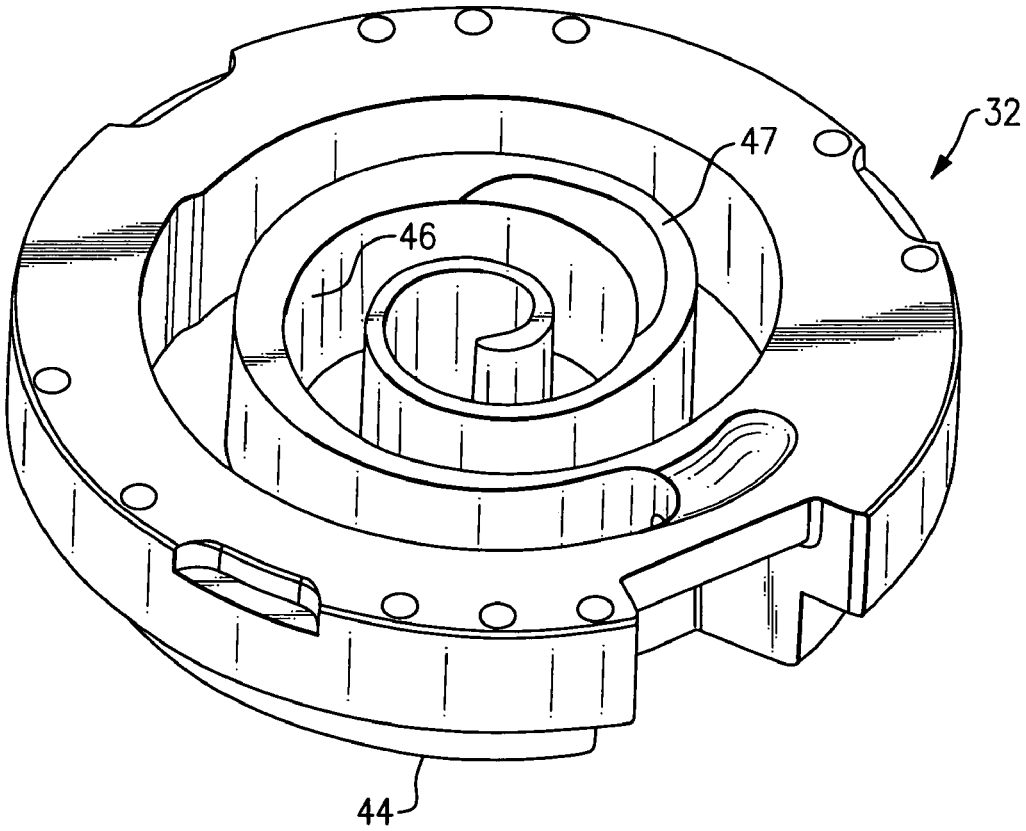
FIG. 2 is a perspective view of a non-orbiting scroll member for use in the scroll compressor of FIG. 1.

FIG. 2 shows a perspective view of the non-orbiting scroll 32 and FIG. 3 shows a perspective view of the orbiting scroll 34. Each of the non-orbiting scroll 32 and orbiting scroll 34 includes a base portion 44 and a generally spiral wrap 46 that extends from the base portion 44 to a tip portion 47. When assembled, the spiral wraps 46 interfit to define compression chambers 36 (FIG. 1) between the non-orbiting scroll 32 and orbiting scroll 34.

In the illustrated example, there is radial and axial compliance (relative to axis A) between the non-orbiting scroll 32 orbiting scroll 34. Compliance allows the scrolls 32 and 34 to separate under certain conditions, such as to allow a particle to pass through the scroll compressor 20. Axial compliance maintains the wrap 46 of the orbiting scroll 34 in contact with the base portion 44 of the non-orbiting scroll 32 to provide a seal under normal operating conditions. A tap T taps a compressed refrigerant to a chamber 100 behind the base 44 of the orbiting scroll 34. The resultant force biases the two scroll members into contact. In other scroll compressors, the chamber can be behind the base of the non-orbiting scroll. Radial compliance maintains the wraps 46 of the non-orbiting scroll 32 and orbiting scroll 34 in contact under normal operating conditions.

Figure 4:
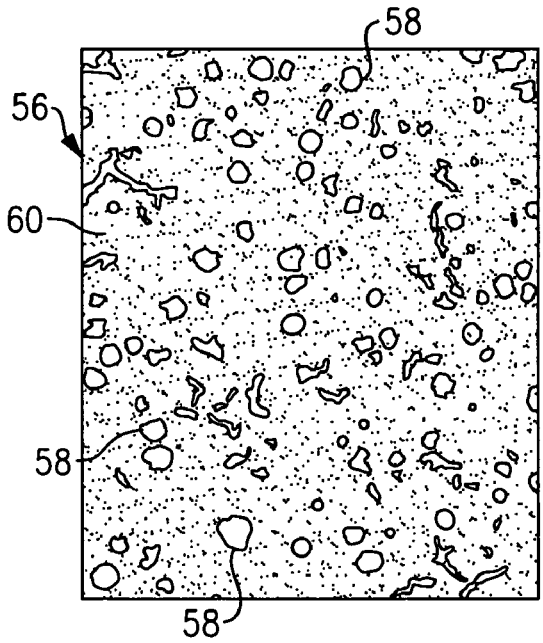
FIG. 4 is a schematic illustration of a microstructure having graphite nodules of a cast iron material used to make the scroll members.

Referring to FIG. 4, one or both of the non-orbiting scroll 32 and orbiting scroll 34 are made of a cast iron material having a microstructure 56 that includes graphite nodules 58. In the illustrated examples, the graphite nodules are within a matrix 60, such as a pearlite matrix. The microstructure 56 in this example is shown at a magnification of approximately 36×. The cast iron material is polished and etched in a known manner to reveal the microstructure 56.

Figure 5:
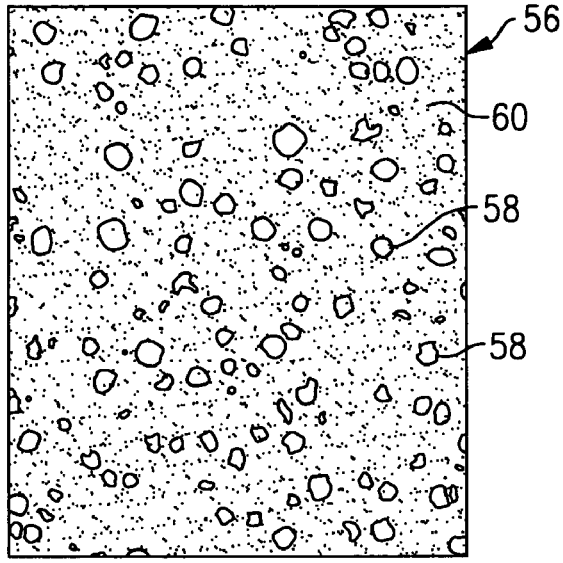
FIG. 5 schematically illustrates another example microstructure having graphite nodules.

The microstructure 56 includes an associated nodularity, which is a ratio of graphite nodules 58 to the total graphite including other forms of graphite, within the matrix 60. In one example, the nodularity is above about 80% and below 100%. In the example shown in FIG. 4, the nodularity is about 80%. In another example shown in FIG. 5, the nodularity is about 99%.

The graphite nodules 58 provide the non-orbiting scroll 32 and the orbiting scroll 34 with strength and durability. Other cast iron microstructures, such as those that include primarily graphite flakes, are weakened due to a notch effect at sharp edges of the graphite flakes. The graphite nodules 58, however, are spheroidal in shape and therefore do not have the sharp edges that weaken the material. Generally, higher nodularity results in higher strength and higher toughness. In one example, the cast iron material with graphite nodules 58 has a tensile strength of at least 60 kpsi. For example, the tensile strength can be tested using ASTM A395 or other known standard. The high strength and durability makes the non-orbiting scroll 32 and the orbiting scroll 34 relatively strong and wear resistant, which allows the scroll compressor 20 to be designed for relatively severe operating conditions and high capacities. In one example, use of cast iron material having graphite nodules 58 allows the wraps 46 to be increased in length (i.e., length extended from base 44) to increase the size of the compression chambers 36 and, in turn, increase the capacity of the scroll compressor 20. Furthermore, the combination of the cast iron material having graphite nodules 58 and with the use of the ether-based lubricant 66 provides the benefit of a high capacity compressor 20 with reduced friction for lowered power consumption.

In one example, the relatively severe operating conditions are caused, at least in part, from the axial and radial compliance between the non-orbiting scroll 32 and the orbiting scroll 34. The axial and radial compliance causes contact between the non-orbiting scroll 32 and the orbiting scroll 34 as described above. During operation of the scroll compressor 20, the contact causes wear and stress between the non-orbiting scroll 32 and the orbiting scroll 34. The strong and durable cast iron material with graphite nodules 58 is suited to withstand such operating conditions. In addition, the use of the ether-based lubricant 66 further enhances operation under such conditions by providing enhanced lubrication. In the disclosed example, at least some of the ether-based lubricant 66 dissolves into the refrigerant and coats the cast iron material with graphite nodules 58 of the non-orbiting scroll 32 and orbiting scroll 34. In the disclosed example, the ether-based lubricant coats the spiral wraps 46, including the tip portions 47, to reduce wear between the scrolls 32 and 34. In other words, the combination of strong and durable cast iron material with graphite nodules 58 and ether-based lubricant 66 with enhanced lubricity provides the benefit of a compressor 20 that is suited for relatively harsh operating conditions.

The cast iron material of the non-orbiting scroll 32 and/or the orbiting scroll 34 includes a graphite nodule-forming agent that promotes formation of the graphite nodules 58 during casting. In one example, the cast iron material composition includes 3.20 wt %-4.10 wt % carbon, 1.80 wt %-3.00 wt % silicon, 0.10 wt %-1.00 wt % manganese, up to 0.050 wt % phosphorous, and an amount of the graphite nodule-forming agent. In a further example, the cast iron material composition includes about 3.60 wt %-3.80 wt % carbon.

In one example, the graphite nodule-forming agent includes magnesium. The magnesium is present in the cast iron material of the non-orbiting scroll 32 and/or the orbiting scroll 34 in an amount between about 0.02 wt % and about 0.08 wt %. In another example, the magnesium is present in an amount between about 0.03 wt % and about 0.06 wt %.

In another example, the graphite nodule-forming agent is an alloy, such as an alloy of magnesium. In one example, the alloy includes magnesium and nickel. The magnesium comprises between about 4 wt % and about 18 wt % of the alloy, the balance being nickel and possibly trace amounts of other materials.

In another example, the graphite nodule-forming agent includes both magnesium and cesium. In one example, the magnesium is present in the cast iron material of the non-orbiting scroll 32 and/or the orbiting scroll 34 in an amount as described above and the cesium is present in an amount between about 0.0005 wt % and about 0.01 wt %. The magnesium and cesium are added to the molten cast iron as described above. Alternatively, or in addition to magnesium and cesium, a rare earth metal is used in an amount up to 0.300 wt % to form the graphite nodules 58. Example rare earth metals include praseodymium, neodymium, promethium, samarium, europium, gadolinium, terbium, dysprosium, holmium, erbium, thulium, ytterbium, lutetium, yttrium, scandium, thorium, and zirconium, although use of these may be limited by availability and/or cost.

The graphite nodule-forming agent is added to molten cast iron during the casting process of the non-orbiting scroll 32 and/or the orbiting scroll 34. For example, the amount added is suitable to result in the composition ranges described above.

The amount of graphite nodule-forming agent added to the molten cast iron is generally greater than the above-described composition ranges. In one example, about 0.3 wt % graphite nodule-forming agent is added. This provides the benefit of adding enough graphite nodule-forming agent to promote graphite nodule 58 formation while allowing for depletion of the graphite nodule-forming agent, such as through volatilization. Given this description, one of ordinary skill in the art will recognize suitable graphite nodule-forming agent amounts to add to the molten cast iron to meet their particular needs.

The amount of graphite nodule-forming agent controls the nodularity of the microstructure 56. For example, a relatively small amount leads to lower nodularity and a relatively larger amount leads to a higher nodularity. Thus, the graphite nodule-forming agent composition ranges described herein can be used to tailor the properties, such as strength, wear, and galling, of the non-orbiting scroll 32 and/or the orbiting scroll 34 to the particular operational demands of the scroll compressor 20.

Figure 6:
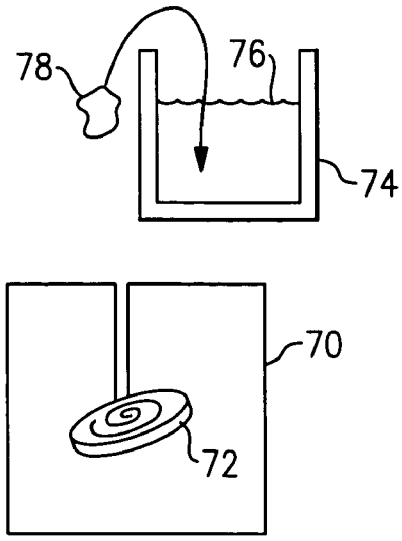
FIG. 6 schematically illustrates an example casting process.

FIG. 6 schematically illustrates an example casting process. A casting mold 70 defines a cavity 72 for forming the shape of the non-orbiting scroll 32 or orbiting scroll 34. A container 74, such as a ladle, holds molten cast iron material 76, which will be poured into the casting mold 70 and solidify. Before pouring, a graphite nodule-forming agent 78 is added to the molten cast iron material 76. Optionally, a predetermined period of time elapses between adding the graphite nodule-forming agent and pouring the molten cast iron material 76 into the casting mold 70 to allow dispersion of the graphite nodule-forming agent 78 in the molten cast iron material.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a non-orbiting scroll member and an orbiting scroll member each having a base and a generally spiral wrap that extends from said base, said spiral wraps inter-fit to define a compression chamber there between, wherein said non-orbiting scroll member and said orbiting scroll member each comprise a microstructure having graphite nodules, and said non-orbiting scroll member and said orbiting scroll member are radially and axially compliant relative to each other; and an ether-based lubricant that coats at least a portion of said non-orbiting scroll member and said orbiting scroll member, wherein said ether-based lubricant has a viscosity between about 1 cSt@40° C. and about 140 cSt@40° C.

2. The scroll member as recited in claim 1, comprising at least one bearing adjacent said orbiting scroll member, wherein said at least one bearing is coated with said ether-based lubricant.

3. The scroll compressor as recited in claim 2, wherein said at least one bearing includes a first bearing and a second bearing that are each at least partially coated with said ether-based lubricant.

4. The scroll compressor as recited in claim 3, wherein said at least one bearing includes a third bearing coated at least partially with said ether-based lubricant.

5. The scroll compressor as recited in claim 1, wherein said ether-based lubricant comprises polyvinylether.

6. The scroll compressor as recited in claim 5, wherein said polyvinylether comprises an extreme pressure additive.

7. The scroll compressor as recited in claim 6, wherein said extreme pressure additive comprises phosphate.

8. The scroll compressor as recited in claim 7, wherein said extreme pressure additive comprises tricresylphosphate.

9. The scroll compressor as recited in claim 1, wherein said ether-based lubricant has a viscosity between about 10 cSt@40° C. and about 68 cSt@40° C.

10. The scroll compressor as recited in claim 9, wherein said ether-based lubricant has a viscosity of about 22 cSt@40° C.

11. The scroll compressor as recited in claim 1, further comprising a chamber adjacent one of said bases, said chamber including pressurized refrigerant biasing said non-orbiting scroll member and said orbiting scroll member together to control radial and axial compliance between said non-orbiting scroll member and said orbiting scroll member.

12. The scroll compressor as recited in claim 11, wherein said base that is adjacent to said chamber includes a tap fluidly connecting said chamber to said compression chamber between said spiral wraps.

* * * * *